US007261092B1

(12) United States Patent
Oku et al.

(10) Patent No.: US 7,261,092 B1
(45) Date of Patent: Aug. 28, 2007

(54) FUEL-VAPOR PROCESSING SYSTEM

(75) Inventors: Masaru Oku, Saitama (JP); Jun Iwamoto, Saitama (JP); Hitoshi Mikami, Saitama (JP); Shigeki Muroga, Saitama (JP); Gaku Hatano, Saitama (JP); Masakazu Kitamoto, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/726,673

(22) Filed: Mar. 22, 2007

(30) Foreign Application Priority Data

Apr. 18, 2006 (JP) ..... 2006-114962

(51) Int. Cl.
*F02M 37/04* (2006.01)

(52) U.S. Cl. ..... 123/516; 123/520

(58) Field of Classification Search ..... 123/516, 123/520, 519, 518, 525
See application file for complete search history.

(56) References Cited

U.S. PATENT DOCUMENTS 4,175,527 A * 11/1979 Sanada et al. ..... 123/514
5,275,145 A * 1/1994 Tuckey ..... 123/521
5,579,740 A * 12/1996 Cotton et al. ..... 123/516
5,868,119 A * 2/1999 Endo et al. ..... 123/516
6,176,259 B1 * 1/2001 Harde et al. ..... 137/587
6,526,950 B2 3/2003 Ito et al.
6,786,207 B2 * 9/2004 Kojima et al. ..... 123/516
7,069,916 B2 * 7/2006 Osanai ..... 123/516
2001/0052292 A1 * 12/2001 Ito ..... 96/134

FOREIGN PATENT DOCUMENTS

JP 2001-295703 10/2001
JP 2004-132263 4/2004

* cited by examiner

*Primary Examiner*—Carl S. Miller
(74) *Attorney, Agent, or Firm*—Carrier, Blackman & Associates, P.C.; Joseph P. Carrier; William D. Blackman

(57) ABSTRACT

A system for processing fuel vapor includes a fuel tank having a pressure gauge, a gas separation membrane module having a gas separation membrane for separating fuel vapor into condensed fuel vapor and fuel lean vapor, a fuel-vapor dissolution device for introducing condensed fuel vapor discharged into the fuel tank and dissolving this condensed fuel vapor in fuel, a canister having an adsorption part adsorbing fuel vapor in fuel lean vapor and a desorption device desorbing fuel vapor from the adsorption part, and an ECU programmed to, when the internal pressure of the fuel tank detected by the pressure gauge is at least a predetermined value, drive the pump to actuate the system so as to process fuel vapor. An objective of the present invention is to provide a fuel-vapor processing system that can process fuel vapor even during periods when the engine is stopped and does not require separation of fuel vapor at multiple stages, complicated control of the flow rate of fuel vapor and the flow rate of permeated gas, or liquefaction of fuel vapor.

3 Claims, 6 Drawing Sheets

FUEL-VAPOR PROCESSING SYSTEM

This application is based on and claims the benefit of priority from Japanese Patent Application No. 2006-114962, filed on 18 Apr. 2006, the content of which is incorporated herein by reference.

BACKGROUND OF THE INVENTION

1. Field of the Invention

The present invention relates to a system for processing fuel vapor generated in a fuel tank mounted on an automotive vehicle, etc.

2. Related Art

It is well known that fuel vapor due to volatilization of fuel, as a result of an increase in temperature, fills a fuel tank mounted on an automotive vehicle, etc., which in turn increases the internal pressure of the fuel tank in the closed state thereof. If the internal pressure of the fuel tank is equal to or greater than a predetermined value, there is a possibility that fuel vapor can flow into an engine making starting of the engine impossible, or leaks from the joints of fuel lines, etc. For this reason, the rise in internal pressure of the fuel tank is suppressed by discharging fuel vapor from the fuel tank. When discharging fuel vapor, fuel vapor is introduced into a device filled with activated carbon or the like, referred to as a vapor canister, in which the fuel vapor is adsorbed by activated carbon or the like, thus resulting in the discharge of purified gas into the atmosphere.

For the continuous use of the vapor canister, a process of adsorbing fuel vapor as well as a process of collecting adsorbed fuel vapor is required. In order to continuously perform the process of adsorbing fuel vapor and the process of collecting adsorbed fuel vapor, a system having a means or device for controlling the processes is required. Thus, various fuel-vapor processing systems have been developed conventionally.

By way of example, Japanese Published Unexamined Patent Application Publication No. 2001-295703 discloses a fuel-vapor recovery device including a canister having an adsorption means for adsorbing fuel vapor introduced from a fuel tank, and a membrane separation module for separating fuel vapor flowing from a discharge port of the canister into an air rich component and a fuel-vapor rich component by a separation membrane having selective air permeability, in which the membrane separation module has a discharge port for the air rich component, which is disposed on the permeable side of the separation membrane and is connected to the induction pipe of the engine so that the membrane separation module is actuated by a membrane separation driving force generated by the negative pressure of the engine, and a discharge port of the fuel-vapor rich component, which is disposed on the nonpermeable side of the separation membrane and is connected to the fuel tank so that a fuel-vapor component contained in the fuel-vapor rich component is liquefied in the fuel tank or absorbed in liquid fuel for recovery.

With this fuel-vapor recovery device, since air containing fuel vapor, generated in the fuel tank or by purging the canister, is separated by the selective air permeability-type membrane separation module using the engine's negative pressure as a membrane separation driving force, no mounting of a vacuum pump is required. Moreover, even if a membrane-permeated component derived from the membrane separation module is introduced into the induction pipe of the engine, no influence is exerted on the components of the discharged gas. Furthermore, even if a large amount of fuel vapor is produced, no fuel vapor is released into the atmosphere.

Japanese Published Unexamined Patent Application Publication No. 2004-132263 discloses an evaporated-fuel processing device for an internal combustion engine, including a canister for adsorbing evaporated fuel generated in a fuel tank, a feed pump for feeding fuel in the fuel tank to the internal combustion engine, a fuel vapor separation unit for separating process gas containing a high concentration of fuel vapor from purge gas purged from the canister, a process-gas passage for circulating process gas to a suction port of the feed pump, a bubble discharge passage for discharging air bubbles led to the suction port of the feed pump, and a temperature reduction unit for reducing the temperature of an outlet of the bubble discharge passage with respect to the temperature of an inlet thereof. With this evaporated-fuel processing device, evaporated fuel can be processed by condensing evaporated fuel generated in the fuel tank, which is then taken into in the feed pump.

SUMMARY OF THE INVENTION

With the fuel-vapor recovery device disclosed in Japanese Published Unexamined Patent Application Publication No. 2001-295703, since the membrane separation module is actuated using the negative pressure generated by the engine as the membrane separation driving force, fuel vapor can not be processed during periods when the engine is stopped or when the negative pressure generated by the engine is low. Moreover, since the fuel-vapor recovery device disclosed in Japanese Published Unexamined Patent Application Publication No. 2001-29570 includes a separation membrane having selective air permeability as the separation membrane used in the membrane separation module, complicated control of a flow rate of the fuel-vapor rich component and a flow rate of the air rich component are required to efficiently exploit the function of the membrane separation module.

With the evaporated fuel processing device disclosed in Japanese Published Unexamined Patent Application Publication No. 2004-132263, since the feed pump is used to obtain the membrane separation driving force of the evaporated-fuel separation unit, not only is evaporated fuel not able to be processed during periods when the engine is stopped, but a large amount of evaporated fuel can not be processed due to the capacity for evaporated fuel being dependent on fuel consumption. Moreover, since the evaporated fuel processing device disclosed in Japanese Published Unexamined Patent Application Publication No. 2004-132263 includes a separation membrane for separating evaporated fuel using the difference in solubility to the membrane between evaporated fuel and air, separation by a membrane has to be performed at multiple stages. Furthermore, since separated evaporated fuel is supplied to the feed pump, evaporated fuel has to be liquefied by compression.

The present invention is made in view of the abovementioned problems. It is an objective of the present invention to provide a fuel-vapor processing system that can process fuel vapor even during periods when the engine is stopped and does not require separation of fuel vapor at multiple stages, complicated control of the flow rate of fuel vapor and the flow rate of permeated gas, or liquefaction of fuel vapor.

The present inventors have found that efficient processing of fuel vapor can be performed when separating fuel vapor generated in the fuel tank by the gas separation membrane module so that separated condensed fuel vapor is dissolved in fuel and fuel lean vapor is adsorbed in the canister. Thus, we have brought the present invention to perfection.

In a first aspect of the present invention, a system is provided for processing fuel vapor generated from fuel, including: a fuel tank having a pressure gauge detecting an internal pressure of the fuel tank; a gas separation membrane module including a first introduction port introducing fuel vapor generated in the fuel tank, a gas separation membrane separating fuel vapor introduced from the first introduction port into condensed fuel vapor and fuel lean vapor, a condensed-fuel-vapor discharge port disposed on an inlet side of the gas separation membrane and discharging condensed fuel vapor, and a fuel-lean-vapor discharge port disposed on a permeation side of the gas separation membrane and discharging fuel lean vapor; a first passage that provides fluid communication between the fuel tank and the first introduction port; a fuel-vapor dissolution device that introduces condensed fuel vapor discharged from the condensed-fuel-vapor discharge port into the fuel tank and dissolves the condensed fuel vapor in fuel; a canister including a second introduction port introducing fuel lean vapor discharged from the fuel-lean-vapor discharge port, an adsorption part adsorbing fuel vapor in fuel lean vapor introduced from the second introduction port, a second discharge port including a second control valve and discharging vapor having fuel vapor removed, and a desorption device desorbing fuel vapor from the adsorption part; a fuel-lean-vapor discharge passage that provides fluid communication between the fuel-lean-vapor discharge port and the second introduction port, the fuel-lean-vapor discharge passage including a pump that reduces the pressure of the permeation side of the gas separation membrane; and an electronic control unit (ECU) including a first device that, when the internal pressure of the fuel tank detected by the pressure gauge is at least a predetermined value, drives the pump to actuate the system, and opens the second control valve and a second control device that desorbs fuel vapor adsorbed to the canister through the desorption device.

The system according to the first aspect of the present invention operates as follows. When the internal pressure of the fuel tank is at least a predetermined value by evaporation of fuel stored in the fuel tank, the pressure gauge arranged in the fuel tank detects this pressure rise, and the ECU operates the start of the pump. With the start of the pump, a pressure difference occurs between the permeation side and the inlet side of the gas separation membrane of the gas separation membrane module, so that gas existing on the inlet side permeates the gas separation membrane. As a result, the inlet side of the gas separation membrane provides negative pressure with respect to the inside of the fuel tank, so that fuel vapor in the fuel tank flows into the gas separation membrane module from the first introduction port through the first passage. Of the fuel vapor that has flowed into the gas separation membrane module, an air component including oxygen, nitrogen, etc. is greater in permeation velocity in the gas separation membrane than a fuel-vapor component. Thus, fuel vapor is condensed on the inlet side of the gas separation membrane, providing condensed fuel vapor. This condensed fuel vapor is dissolved in fuel stored in the fuel tank by the fuel-lean-vapor dissolution device. On the other hand, fuel lean vapor that has permeated the gas separation membrane flows through the fuel-lean-vapor discharge passage into the canister from the second introduction port, in which a fuel-vapor component contained in fuel lean vapor is adsorbed onto the adsorption part. Vapor that has undergone the fuel vapor adsorption step is discharged into the atmosphere from the second discharge port.

By repetition of the abovementioned operation, fuel vapor generated in the fuel tank is partly condensed and dissolved in fuel, and is partly adsorbed onto the adsorption part of the canister. With this, the internal pressure of the fuel tank is prevented from being equal to or greater than the predetermined value. Moreover, when the adsorption part adsorbs a sufficient amount of fuel vapor, fuel vapor is desorbed, thus allowing the canister to repeatedly adsorb fuel.

Since the system according to the first aspect of the present invention uses a driving force of the pump, which is independent of the engine, fuel vapor can be processed even during periods when the engine is stopped. Moreover, due to adoption of the gas separation membrane having selective air permeability, fuel vapor can be completely separated even with a single separation process.

In a second aspect of the system as described in the first aspect of the present invention, the system further includes a second passage branching off from the first passage and a passage switching device disposed at a branch point of the first and second passages, the second passage communicating with the fuel-lean-vapor discharge passage between the pump and the fuel-lean-vapor discharge port, the second passage including a check valve, in which the desorption device includes an adsorption-amount detection device that detects the amount of fuel vapor adsorbed onto the adsorption part and a third discharge port including a third control valve, discharging fuel vapor desorbed from the adsorption part and introducing into the gas separation membrane module through the first introduction port, and in which, when an adsorption amount detected by the adsorption-amount detection device is at least a predetermined value, the second control device initiates switching from the first passage to the second passage by the passage switching device, closes the second control valve, and opens the third control valve to thereby desorb fuel vapor adsorbed onto the adsorption part by fuel vapor introduced from the second passage, the desorbed fuel vapor being introduced into and condensed in the gas separation membrane module through the third discharge port and the first introduction port, the condensed fuel vapor being dissolved in fuel stored in the fuel tank by the fuel-vapor dissolution device.

The system according to the second aspect of the present invention operates as follows. When an amount of adsorbed fuel vapor, detected by the adsorption amount detection device, is at least a predetermined value, the ECU instructs the passage switching device to switch from the first passage to the second passage, and simultaneously closes the second control valve and opens the third control valve. When condensed fuel vapor is dissolved in fuel stored in the fuel tank through the fuel-vapor dissolution device, fuel vapor containing a slight amount of fuel-vapor component remains in the fuel tank. This fuel vapor containing a slight amount of fuel-vapor component, which flows from the fuel tank into the fuel-lean-vapor discharge passage through the second passage by a driving force of the pump, is mixed with fuel lean vapor. When flowing into the canister from the second introduction port, mixed fuel lean vapor facilitates desorption of the fuel-vapor component from the adsorption part. Then, this component is discharged from the third discharge port together with desorbed fuel vapor. This vapor flows into the gas separation membrane module from the first introduction port, and is separated into condensed fuel vapor and fuel lean vapor by the driving force of the pump. Condensed fuel vapor is fed to the fuel tank through the fuel-vapor dissolution device, in which the fuel component of the condensed fuel vapor is dissolved in fuel. On the other hand, fuel temuous vapor is again fed into the canister, and repeatedly used to facilitate desorption of the fuel-vapor component from the adsorption part.

Since the system according to the second aspect of the present invention is configured so that fuel vapor flowing into a gas separation membrane module is mixed vapor including, principally, fuel vapor containing a slight amount of fuel vapor component derived from the fuel tank, fuel lean vapor that permeates the gas separation membrane, and fuel vapor desorbed from the adsorption part, a correct volume of condensed fuel vapor can be obtained without relying on complicated controls. Moreover, since the system according to the second aspect of the present invention is configured so that fuel vapor is dissolved in fuel, compression or liquefaction of fuel vapor is not required.

In a third aspect of the system as described in the second aspect of the present invention, the gas separation membrane module includes two gas separation membranes disposed in series and a fourth passage including a fourth control valve and communicating with each permeation side of the two gas separation membranes, in which the ECU includes a third control device that opens the fourth control valve when the passage switching device performs switching from the first passage to the second passage, and closes the fourth control valve when the passage switching device performs switching from the second passage to the first passage, thereby changing the area of the gas separation membrane.

The system according to the third aspect of the present invention operates as follows. When fuel vapor derived from the fuel tank flows into the first introduction port of the gas separation membrane module through the first passage, since the fourth control valve is closed, a pressure difference occurs between the inlet side and the permeation side of one gas separation membrane only, obtaining condensation of fuel vapor at the one gas separation membrane only. On the other hand, when fuel vapor derived from the fuel tank facilitates desorption of a fuel-vapor component from the adsorption part of the canister through the second passage, and then flows into the first introduction port of the gas separation membrane module, since the fourth control valve is opened, a pressure difference occurs between the inlet side and the permeation side of both of the gas separation membranes, obtaining condensation of fuel vapor at both of the gas separation membranes.

When fuel vapor generated from the fuel tank is adsorbed in the canister, the area of the gas separation membrane may be small. On the other hand, when desorbing a fuel-vapor component from the canister and dissolving it in fuel stored in the fuel tank, it is more efficient to use very rich fuel vapor. The present invention allows for such control of an area of the gas separation membrane to be achieved easily.

According to the present invention, fuel vapor generated in the fuel tank is separated by the gas separation membrane module, which is partly dissolved in fuel and partly adsorbed to the canister, and then is released to the atmosphere, thus limiting the rise of the internal pressure of the fuel tank. By desorbing and dissolving a fuel-vapor component adsorbed in the canister, the canister can be used repeatedly.

The system according to the present invention can process fuel vapor even during periods when the engine is stopped. Moreover, the system according to the present invention does not require separation of fuel vapor at multiple stages, complicated control of the flow rate of fuel vapor and the flow rate of permeated gas, or liquefaction of fuel vapor. As a result, processing of fuel vapor can be performed efficiently.

DETAILED DESCRIPTION OF THE INVENTION

First Preferred Embodiment

Figure 1:
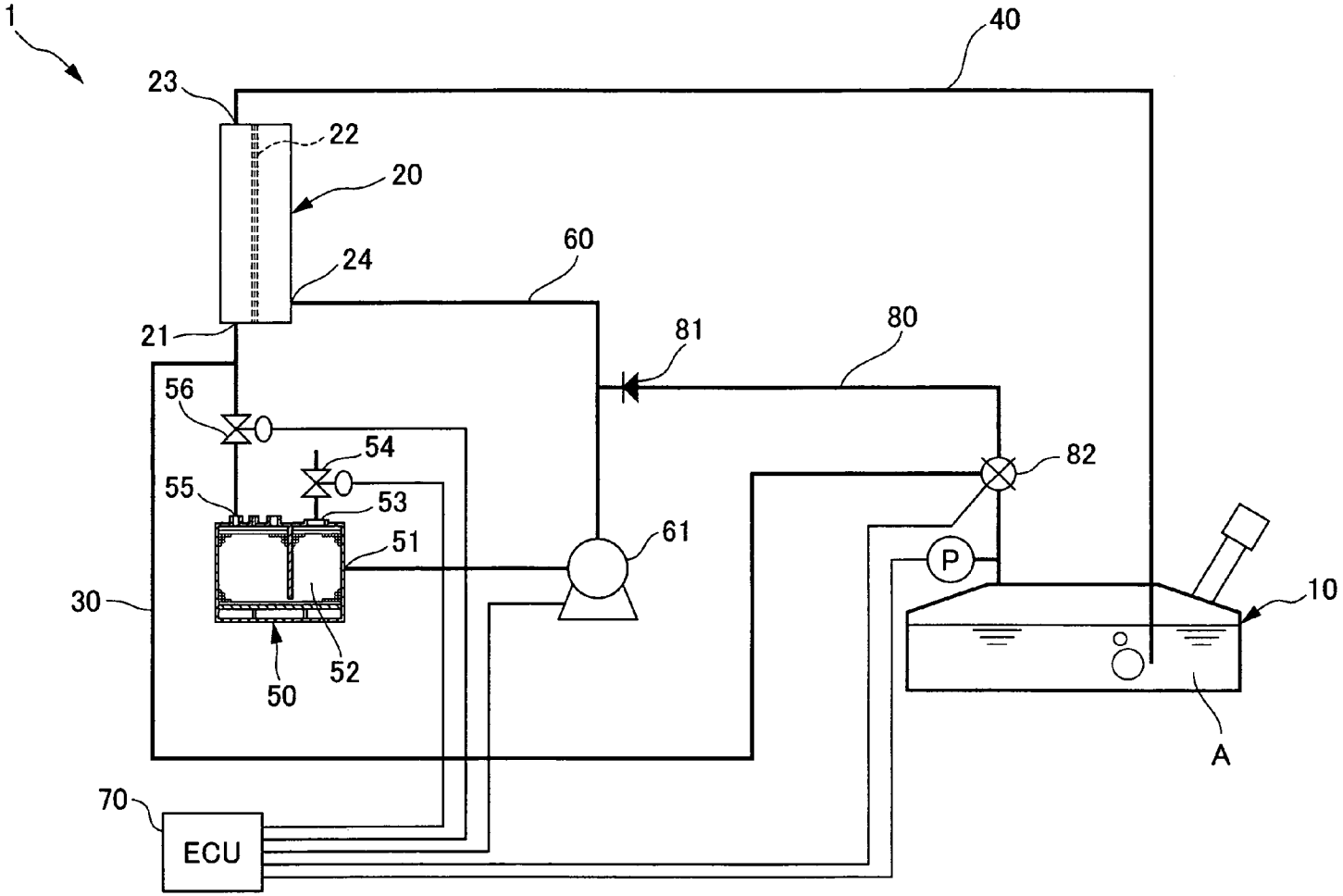
FIG. 1 is a schematic diagram showing a first preferred embodiment of a fuel-vapor processing system according to the present invention.
Figure 3:
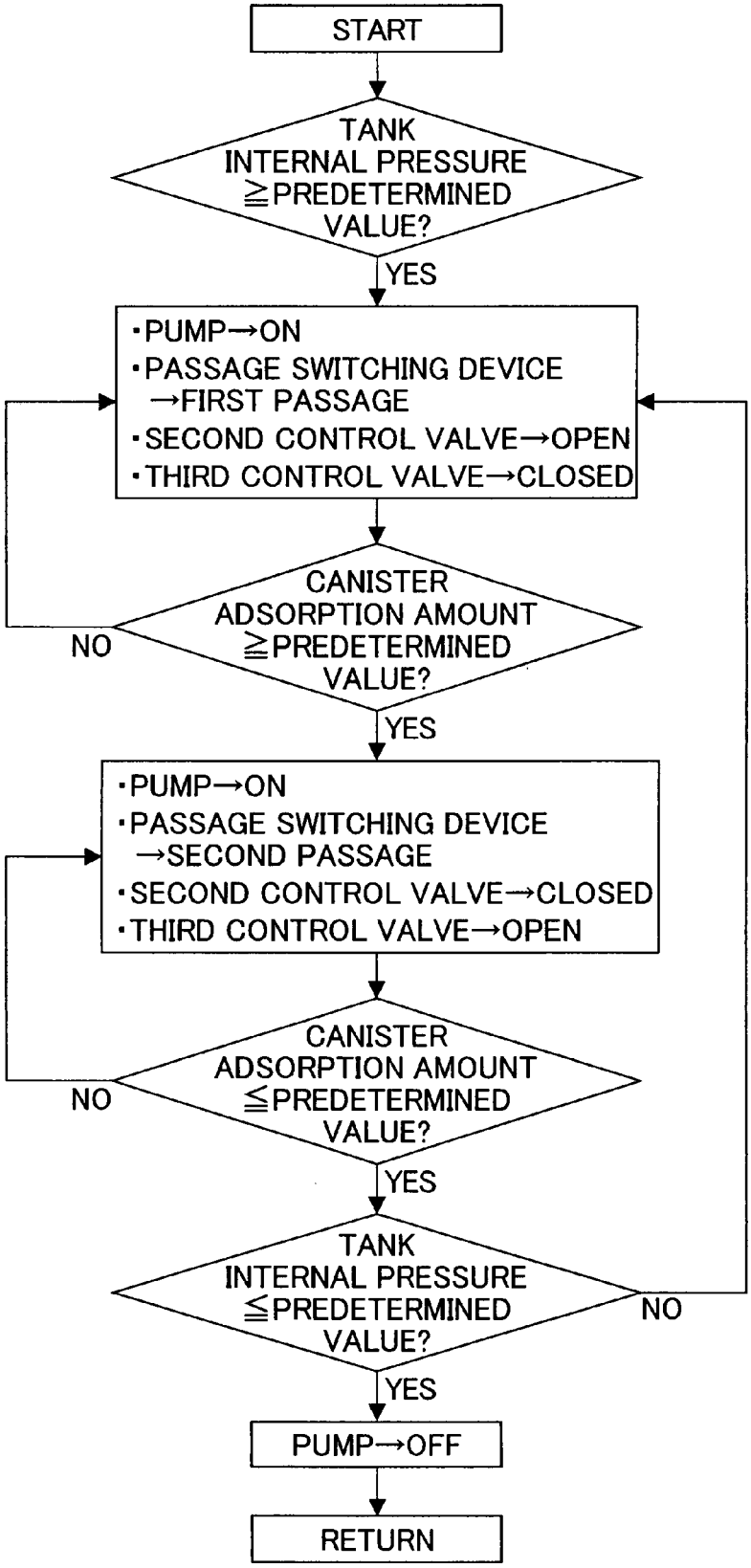
FIG. 3 is a flowchart showing operation of the first preferred embodiment.

Referring to FIGS. 1 and 3, the first preferred embodiment of the present invention is described. FIG. 1 is a schematic diagram showing a fuel-vapor processing system 1 in the first preferred embodiment. FIG. 3 is a flowchart showing operation of the fuel-vapor processing system 1 in the first preferred embodiment.

Configuration of the Fuel-Vapor Processing System

Referring to FIG. 1, the fuel-vapor processing system 1 includes a fuel tank 10 for storing fuel A, a gas separation membrane module 20 for separating fuel vapor generated in the fuel tank 10 into condensed fuel vapor and fuel lean vapor, a first passage 30 for providing communication between the fuel tank 10 and the gas separation membrane module 20, a fifth passage 40, which serves as a fuel-vapor dissolution means or device, for introducing into the fuel tank 10 condensed fuel vapor separated by the gas separation membrane module 20 and dissolving it in fuel A, a canister 50 for adsorbing fuel vapor from fuel lean vapor, a fuel-lean-vapor discharge passage 60 for providing communication between the gas separation membrane module 20 and the canister 50 to introduce fuel lean vapor from the gas separation membrane module 20 into the canister 50, a second passage 80 branching off from the first passage 30 to communicate with the fuel-lean-vapor discharge passage 60, a passage switching means or device 82 disposed at a branching point of the first passage 30 and the second passage 80, and an electronic control unit (ECU) 70 for controlling various devices arranged in the fuel-vapor processing system 1.

Fuel Tank

In this embodiment, the fuel tank 10 includes a pressure gauge P for detecting the internal pressure of the fuel tank 10. Fuel A is stored in the fuel tank 10. The internal pressure of the fuel tank 10 increases by fuel vapor generated by volatilization of fuel A. The fuel tank 10 communicates with a first introduction port 21 (as is described later) of the gas separation membrane module 20 through the first passage 30, and also communicates with a second introduction port 51 (as is described later) of the canister 50 through the second passage 80 branching off from the first passage 30 and the fuel-lean-vapor discharge passage 60 with which the second passage 80 communicates.

Gas Separation Membrane Module

In this embodiment, the gas separation membrane module 20 includes the first introduction port 21 for introducing fuel vapor generated in the fuel tank 10, a gas separation membrane 22 for separating fuel vapor introduced from the first introduction port 21 into condensed fuel vapor and fuel lean vapor, a condensed-fuel-vapor discharge port 23 disposed on the inlet side of the gas separation membrane 22 and for discharging condensed fuel vapor, and a fuel-lean-vapor discharge port 24 disposed on the permeation side of the gas separation membrane 22 and for discharging fuel lean vapor.

First introduction port, condensed-fuel-vapor discharge port, and fuel-lean-vapor discharge port The gas separation membrane module 20 has the first introduction port 21 arranged on one end of the inlet side of the gas separation membrane 22 and the condensed-fuel-vapor discharge port 23 arranged on the other end of the inlet side of the gas separation membrane 22. A fuel-lean-vapor discharge port 24 is arranged on the permeation side of the gas separation membrane 22. The condensed-fuel-vapor discharge port 23 communicates with the fuel tank 10 through the fifth passage 40, and the fuel-lean-vapor discharge port 24 communicates with the second introduction port 51 (as is described later) of the canister 50 through the fuel-lean-vapor discharge passage 60.

Gas Separation Membrane

The gas separation membrane 22 of the gas separation membrane module 20 includes a porous membrane providing different membrane permeation velocities according to the size of gas molecules. The materials of the porous membrane may be resin materials such as polyimide, polysulfone, fluoro-resin, etc. or inorganic materials such as carbon, zeolite, etc. The permeation-velocity ratio of nitrogen to n-butane of the gas separation membrane 22 is preferably four or more.

First Passage

The first passage 30 provides communication between the fuel tank 10 and the first introduction port 21 of the gas separation membrane module 20. The second passage 80 branches off from the first passage 30, and the passage switching means or device 82 is arranged at the branching point of the two passages.

Fifth Passage

The fifth passage 40 provides communication between the condensed-fuel-vapor discharge port 23 of the gas separation membrane module 20 and the fuel tank 10, and has a fuel-tank side end situated in the fuel.

Canister

The canister 50 includes the second introduction port 51 for introducing fuel lean vapor discharged from the fuel-lean-vapor discharge port 24, an adsorption part 52 for adsorbing fuel vapor from fuel lean vapor introduced from the second introduction port 51, a second discharge port 53 for discharging vapor having fuel vapor removed by operation of the adsorption part 52 into the atmosphere, an adsorption-amount detection means or device, not shown, for detecting the amount of fuel vapor adsorbed to the adsorption part 52, and a third discharge port 55 for discharging fuel vapor desorbed from the adsorption part 52 and introducing it into the gas separation membrane module 20 through the first introduction port 21.

Second Introduction Port, Second Discharge Port, and Third Discharge Port

The canister 50 includes the second introduction port 51, the second discharge port 53 arranged adjacent to the second introduction port 51, and third discharge port 55 arranged at a distance from the second introduction port 51. A second control valve 54 and a third control valve 56 are provided to the second discharge port 53 and the third discharge port 55, respectively. Opening and closing of the second control valve 54 and the third control valve 56 are controlled by the ECU 70 in accordance with detection values of the adsorption-amount detection means. The second discharge port 53 is connected to a pipe communicating to the atmosphere, and the third discharge port 55 communicates with the first introduction port 21 through a pipe.

Adsorption Part

The adsorption part 52 of the canister 50 is filled with a material having the capability to adsorb fuel vapor. One example of the material is activated carbon, but without being particularly limited thereto. Activated carbon adsorbs fuel vapor when exposed to mixed gas containing a high concentration of fuel vapor, and desorbs fuel vapor when exposed to mixed gas in which the concentration of fuel vapor is less than a predetermined value. Through the use of these characteristics of activated carbon, the canister 50 can repeatedly perform adsorption and desorption of fuel vapor.

Adsorption-Amount Detection Means or Device

The canister 50 may include an adsorption-amount detection means or device, not shown. One example of the adsorption-amount detection means, but without being particularly limited thereto, is a means or device for detecting a remaining amount of fuel vapor contained in vapor discharged from the second discharge port 53. The remaining-amount detection means may be in the form of a hydrocarbon densimeter. In this embodiment, the absorption-amount detection means can be a device for measuring a weight of the canister 50.

Fuel-Lean-Vapor Discharge Passage

The fuel-lean-vapor discharge passage 60 communicates with the fuel-lean-vapor discharge port 24 and the second introduction port 51, and a pump 61 is provided for reducing the pressure on the permeation side of the gas separation membrane 22. The pump 61 is connected to a battery, not shown. One example of the pump 61 that can be used in the fuel-lean-vapor discharge passage 60 is a conventionally known vacuum pump, but without being particularly limited thereto.

Second Passage

The second passage 80 branches off from the first passage 30 to communicate with the fuel-lean-vapor discharge passage 60 between the pump 61 and the fuel-lean-vapor discharge port 24. A check valve 81 for restraining backflow of fuel vapor from the fuel-lean-vapor discharge passage 60 to the first passage 30 is provided to the second passage 80. With this, backflow of fuel vapor from the canister 50 to the first passage 30 and, thus, to the fuel tank 10 can be prevented when the pump 61 is stopped.

Passage Switching Means or Device

The passage switching means or device 82 is arranged at the branching point of the first passage 30 and the second passage 80. Switching between the first passage 30 and the second passage 80 is controlled by the ECU 70 in accordance with detection values of the adsorption-amount detection means.

ECU

The ECU 70 inputs signals indicative of detection values of the pressure gauge P and detection values of the adsorption-amount detection means, and outputs signals for opening and closing of the second control valve 54 and the third control valve 56, start and stop of the pump 61, and switching between the passages through the passage switching means 82.

Operation of the fuel-vapor processing system

Referring to FIG. 3, the fuel-vapor processing system 1 operates as follows.

Operation by a First Control Means or Device

When the internal pressure of the fuel tank 10 is at least a predetermined value arising as a result of the evaporation of fuel A stored in the fuel tank 10, the pressure gauge P arranged in the fuel tank 10 detects this pressure rise, and the ECU 70 starts the pump 61, initiates the passage switching means 82 to perform switching to the first passage 30, opens the second control valve 54, and closes the third control valve 56. With the start of the pump 61, a pressure difference occurs between the permeation side and the inlet side of the gas separation membrane 22 of the gas separation membrane module 20, so that gas existing on the inlet side permeates the gas separation membrane 22. As a result, the inlet side of the gas separation membrane 22 provides negative pressure with respect to the inside of the fuel tank 10, so that fuel vapor in the fuel tank 10 flows into the gas separation membrane module 20 from the first introduction port 21 through the first passage 30. Of the fuel vapor that flows into the gas separation membrane module 20, the air component including oxygen, nitrogen, etc. is greater in permeation velocity in the gas separation membrane 22 than the fuel-vapor component. Thus, fuel vapor is condensed on the inlet side of the gas separation membrane 22, providing condensed fuel vapor. This condensed fuel vapor is discharged from the condensed-fuel-vapor discharge port 23, and is introduced through the fifth passage 40 into the fuel tank 10 to be dissolved in fuel A stored therein.

On the other hand, fuel lean vapor that has permeated the gas separation membrane 22 flows through the fuel-lean-vapor discharge passage 60 into the canister 50 from the second introduction port 51, in which a fuel-vapor component contained in fuel lean vapor is adsorbed onto the adsorption part 52. Vapor having fuel vapor adsorbed is discharged into the atmosphere from the second discharge port 53.

By repetition of the abovementioned operation, fuel vapor generated in the fuel tank 10 is partly condensed and dissolved in fuel A, and is partly adsorbed onto the adsorption part 52 of the canister 50. With this, the internal pressure of the fuel tank 10 can be prevented from being at least the predetermined value.

Operation by a Second Control Means or Device

When the amount of adsorbed fuel vapor detected by the adsorption amount detection means is at least the predetermined value, the ECU 70 instructs the passage switching means 82 to perform switching from the first passage 30 to the second passage 80, and simultaneously closes the second control valve 54 and opens the third control valve 56. When condensed fuel vapor is dissolved in fuel A stored in the fuel tank 10 through the fifth passage 40, fuel vapor containing a slight amount of fuel-vapor component remains in the fuel tank 10. This fuel vapor containing a slight amount of fuel-vapor component, which flows from the fuel tank 10 into the fuel-lean-vapor discharge passage 60 through the second passage 80 by the driving force of the pump 61, is mixed into fuel lean vapor. When flowing into the canister 50 from the second introduction port 51, mixed fuel lean vapor facilitates desorption of the fuel-vapor component from the adsorption part 52. Then, it is discharged from the third discharge port 55 together with the desorbed fuel vapor. This vapor flows into the gas separation membrane module 20 from the first introduction port 21, and is separated into condensed fuel vapor and fuel lean vapor by the driving force of the pump 61. Condensed fuel vapor is fed to the fuel tank 10 through the fifth passage 40, in which the fuel component in condensed fuel vapor is dissolved in fuel A. On the other hand, fuel lean vapor is again fed to the canister 50, this process is repeatedly performed to facilitate desorption of the fuel-vapor component from the adsorption part 52.

When an amount of adsorption of fuel vapor detected by the adsorption-amount detection means is smaller than the predetermined value and a detection value of the pressure gauge P is at least a predetermined value, the ECU 70 instructs the passage switching means 82 to perform switching from the second passage 80 to the first passage 30, opens the second control valve 54, and closes the third control valve 56 again. With this, separation of fuel vapor by the gas separation membrane module 20 and adsorption thereof by the canister 50 are repeatedly performed.

During operation of the second control means, when the amount of adsorption of fuel vapor detected by the adsorption-amount detection means is smaller than the predetermined value and a detection value of the pressure gauge P is smaller than the predetermined value, the ECU 70 stops the pump 61, thus stopping the fuel-vapor processing system 1.

Effect of the fuel-vapor processing system

In this embodiment, since the fuel-vapor processing system 1 uses the driving force of the pump 61, which is independent of the engine, fuel vapor can be processed even during periods when the engine is stopped. Moreover, due to the adoption of the gas separation membrane 22, fuel vapor can fully be separated even with a single separation process.

In this embodiment, since the fuel-vapor processing system 1 is configured so that the fuel vapor flowing into the gas separation membrane module 20 is mixed vapor including, principally, fuel vapor containing a slight amount of fuel vapor component derived from the fuel tank 10, fuel lean vapor that permeated the gas separation membrane 22, and fuel vapor desorbed from the adsorption part 52, a correct volume of condensed fuel vapor can be obtained without relying on complicated control. Moreover, since the fuel-vapor processing system 1 is configured so that fuel vapor is dissolved in fuel A, compression or liquefaction of fuel vapor is not required.

Second Preferred Embodiment

Figure 2:
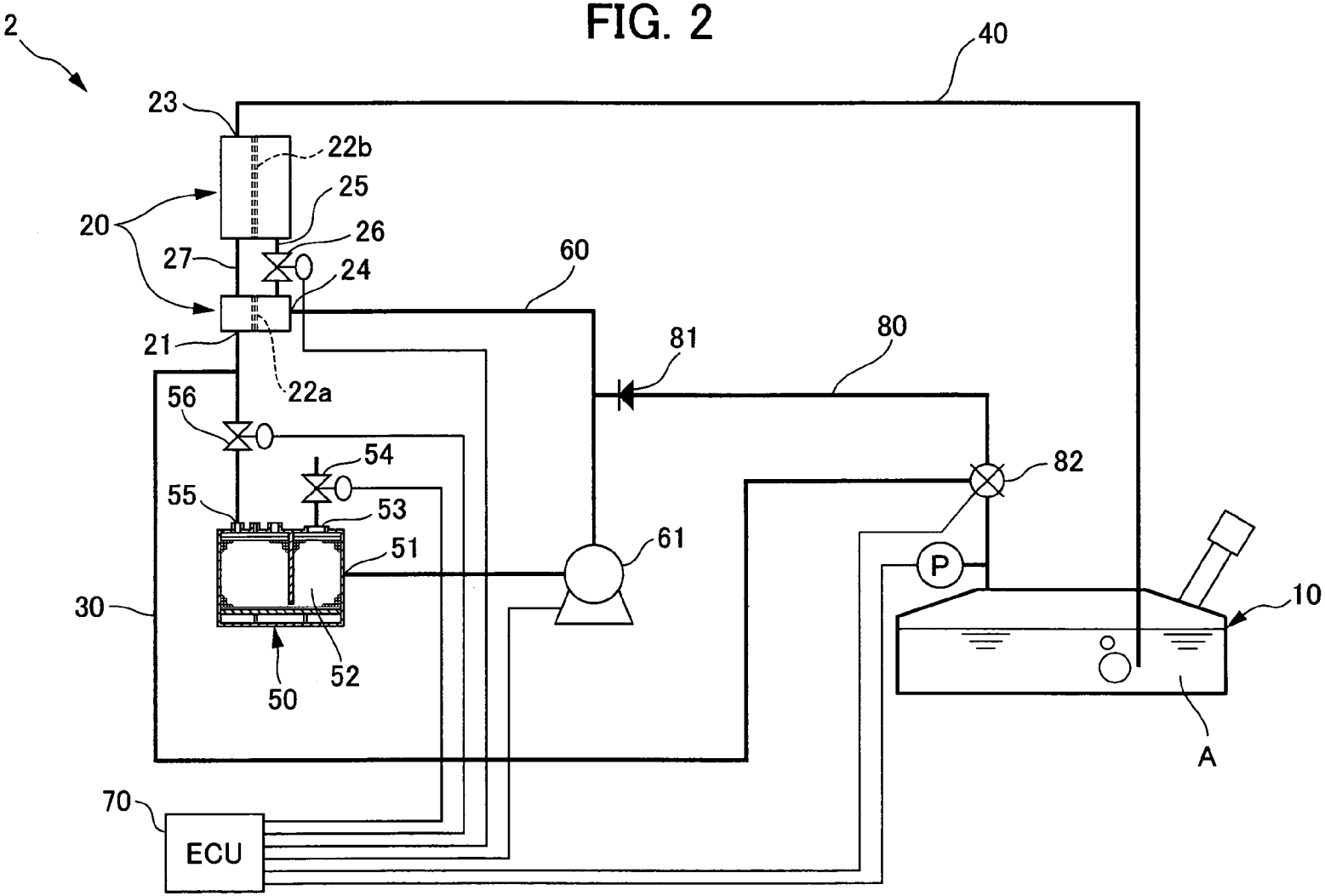
FIG. 2 is a schematic diagram showing a second preferred embodiment of a fuel-vapor processing system according to the present invention.

Referring to FIG. 2, the second preferred embodiment of the present invention is described. In the second preferred embodiment shown in FIG. 2, like reference numerals designate like parts described in the first preferred embodiment as shown in FIG. 1. FIG. 2 is a schematic diagram showing the second preferred embodiment of a fuel-vapor processing system 2 according to the present invention.

Configuration of the Fuel-Vapor Processing System

Gas Separation Membrane Module

Referring to FIG. 2, the fuel-vapor processing system 2 includes a gas separation membrane module 20 including a first gas separation membrane 22*a* and a second gas separation membrane 22*b* disposed in series, a first introduction port 21 disposed on the inlet side of the first gas separation membrane 22*a* and for introducing fuel vapor generated in a fuel tank 10, a condensed-fuel-vapor discharge port 23 disposed on the inlet side of the second gas separation membrane 22*b*, which separates fuel vapor introduced from the first introduction port 21 into condensed fuel vapor and fuel lean vapor, for discharging condensed fuel vapor, a fuel-lean-vapor discharge port 24 disposed on the permeation side of the first gas separation membrane 22*a* for discharging fuel lean vapor, and a fourth passage 25 for connecting the permeation side of the second gas separation membrane 22*b* and the permeation side of the first gas separation membrane 22*a*. A fourth control valve 26 is provided to the fourth passage 25, and is opened and closed by an electronic control unit (ECU) 70 in accordance with detection values of an adsorption-amount detection means or device, not shown.

Operation of the Fuel-Vapor Processing System

When fuel vapor derived from the fuel tank 10 flows into the first introduction port 21 of the gas separation membrane module 20 through a first passage 30, since the fourth control valve 26 is closed, a pressure difference occurs between the inlet side and the permeation side of the first gas separation membrane 22*a* only, obtaining condensation of fuel vapor at the first gas separation membrane 22*a* only. On the other hand, when fuel vapor derived from the fuel tank 10 facilitates desorption of a fuel-vapor component from an adsorption part 52 of a canister 50 through a second passage 80, and then flows into the first introduction port 21 of the gas separation membrane module 20, since the fourth control valve 26 is opened, a pressure difference occurs between the inlet side and the permeation side of both the first gas separation membrane 22*a* and the second gas separation membrane 22*b*, condensing fuel vapor at both the first gas separation membrane 22*a* and the second gas separation membrane 22*b*.

Effect of the Fuel-Vapor Processing System

During separation of fuel vapor performed when adsorbing fuel vapor generated from the fuel tank 10 to the canister 50, the area of the gas separation membrane may be small. On the other hand, during separation of fuel vapor performed when desorbing a fuel-vapor component from the canister 50 and dissolving it in fuel A stored in the fuel tank 10, it is more efficient to use very rich fuel vapor. The present invention allows easy control of the area of the gas separation membrane.

TEST EXAMPLE 1

Diurnal Breathing Loss (DBL) Test

In order to check the effect of reducing the amount of generated fuel vapor by the first control means, a test referred to as the DBL test was performed to measure the amount of fuel vapor generated when a vehicle was at a standstill in the low-temperature/high-temperature cycle. Specifically, in the DBL test, the temperature of the fuel tank was increased from 18.2° C. to 40.2° C. to generate fuel vapor required for one-day DBL test, which was introduced into the gas separation membrane module. The gas separation membrane module had a membrane "UBE $N_2$ separator" manufactured by UBE INDUSTRIES, LTD., wherein polyimide has a nitrogen permeability of 6.6 GPU and a gas permeation selectivity of 5.75 in oxygen/nitrogen ratio and 14 in nitrogen/hydrocarbon ratio. The vacuum pump was "DAP-12S (10 W)" manufactured by ULVAC KIKO Inc. (indicated as "DAP-12S (10W)" in FIG. 4).

Figure 4:
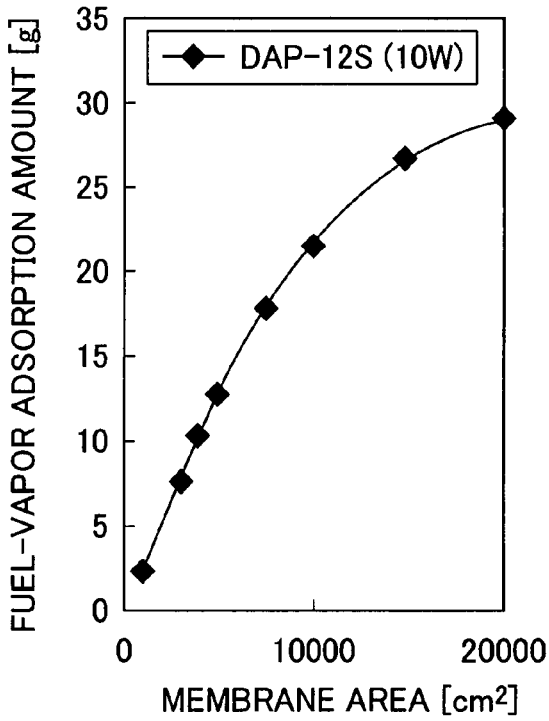
FIG. 4 is a graph illustrating the relationship between an area of a gas separation membrane and the amount of fuel-vapor adsorbed.

FIG. 4 is a graph illustrating the relationship between an area of the gas separation membrane and an amount of fuel vapor adsorbed to the canister. It can be seen from FIG. 4 that the amount of permeation of fuel vapor and, thus, the amount of adsorption thereof increases with increasing area of the gas separation membrane.

TEST EXAMPLE 2

Dissolution of Condensed Fuel Vapor in Fuel

Figure 5:
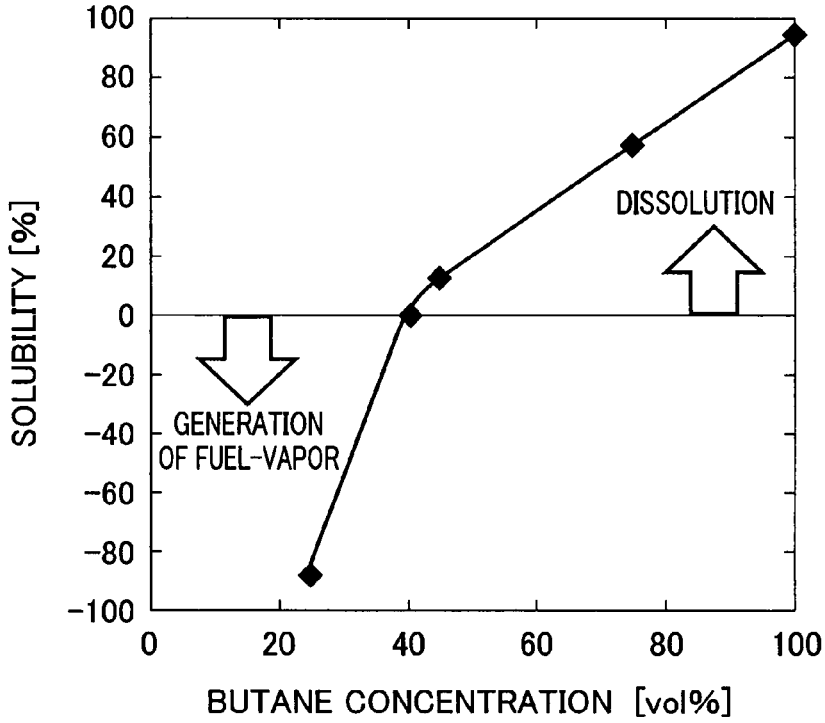
FIG. 5 is a graph illustrating the relationship between the concentration of butane in fuel vapor and the solubility of a fuel-vapor component.

Dissolution of butane or generation of butane vapor was checked by bubbling different concentrations of butane vapor in butane stored in the fuel tank. FIG. 5 is a graph illustrating the relationship between a concentration of butane in fuel vapor and the solubility of a fuel-vapor component. As can be seen from FIG. 5, when bubbling a 40% or higher concentration of butane vapor, a butane-vapor component dissolves in fuel. On the other hand, when bubbling a less than 40% concentration of butane vapor, butane volatilizes. It is to be noted that butane vapor is a main component of fuel vapor. It can be seen from FIG. 5 that the concentration of fuel vapor is, preferably, at least 90% butane to efficiently dissolve a fuel-vapor component.

TEST EXAMPLE 3

Flow-Rate Control Test

Figure 6:
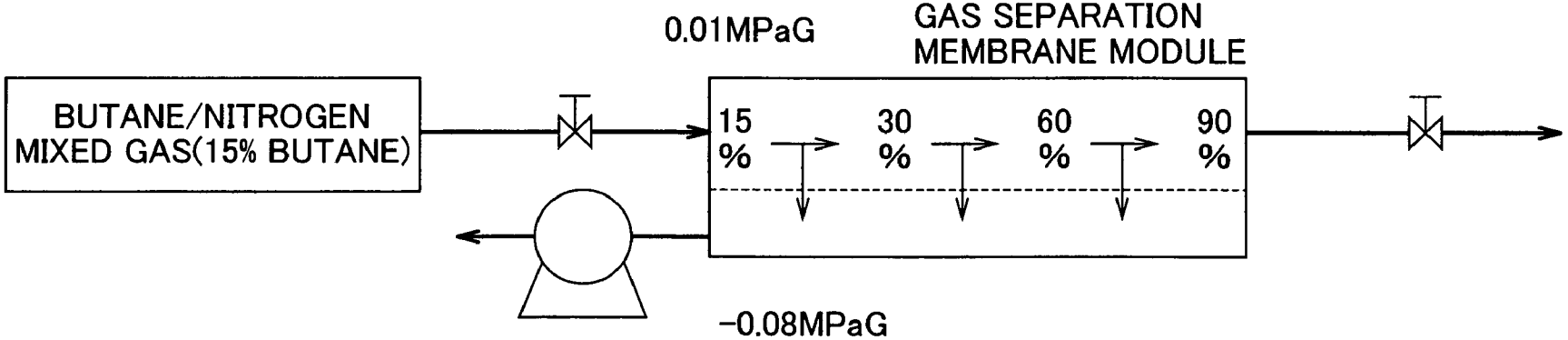
FIG. 6 is a schematic diagram showing a test device used in test example 3.
Figure 7:
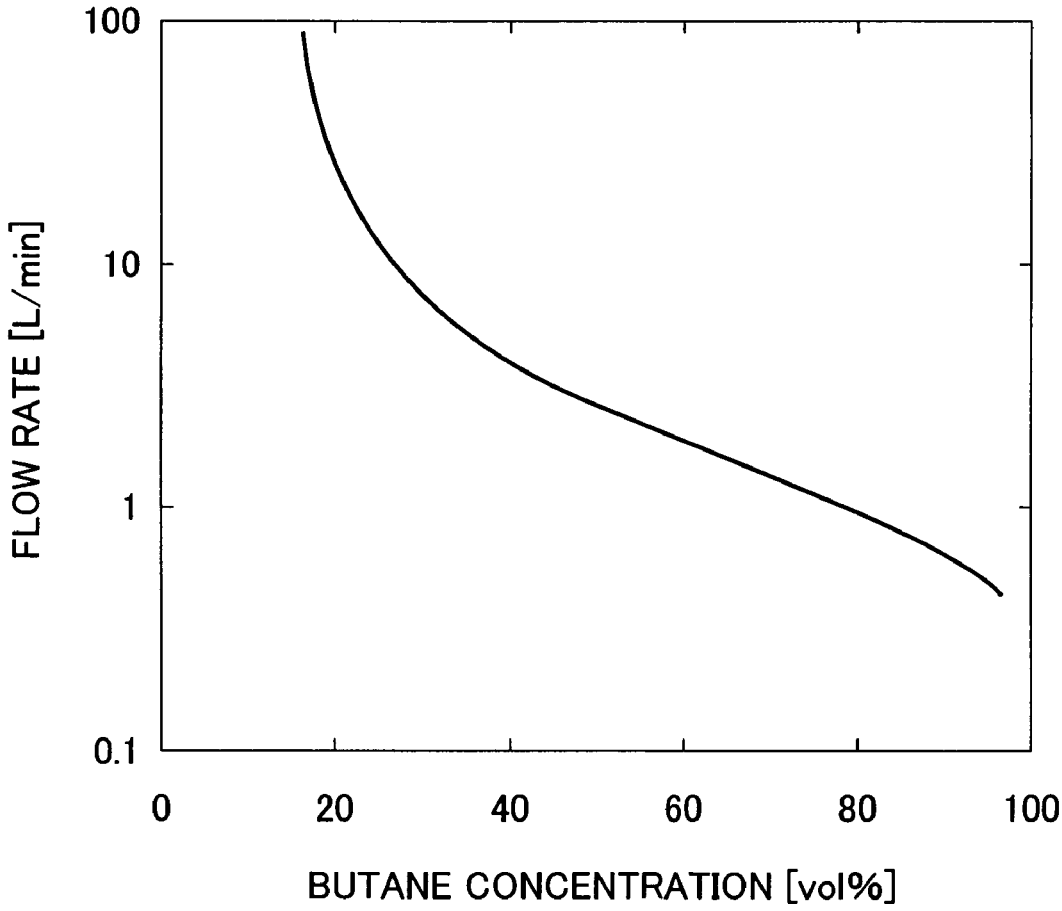
FIG. 7 is a graph illustrating the relationship between the flow rate of a mixed gas introduced into a gas separation membrane module and the concentration of butane in a condensed mixed gas.

FIG. 6 is a schematic diagram showing a test device used in test example 3. FIG. 7 is a graph illustrating the relationship between the flow rate of a mixed gas introduced into the gas separation membrane module and the concentration of butane in the condensed mixed gas. Referring to FIGS. 6 and 7, passing a butane/nitrogen mixed gas (containing 15% butane) through the gas separation membrane module, the relationship between the flow rate of the mixed gas introduced into the gas separation membrane module and the concentration of butane in the condensed mixed gas was examined. The gas separation membrane was polyimide manufactured by UBE INDUSTRIES, LTD., having a gas permeation selectivity of 10 in nitrogen/hydrocarbon ratio. It can be seen from FIG. 7 that the concentration of butane in the condensed mixed gas can be controlled by controlling the flow rate of the mixed gas introduced into the gas separation membrane module.

While the preferred embodiments of the present invention have been described and illustrated above, it is to be understood that they are exemplary of the invention and are not to be considered as limiting. Additions, omissions, substitutions, and other modifications can be made thereto without departing from the spirit or scope of the present invention. Accordingly, the invention is not to be considered to be limited by the foregoing description and is only limited by the scope of the appended claims.

What is claimed is:

1. A system for processing fuel vapor generated from fuel, comprising:

a fuel tank including a pressure gauge detecting an internal pressure of the fuel tank;

a gas separation membrane module including a first introduction port introducing fuel vapor generated in the fuel tank, a gas separation membrane separating fuel vapor introduced from the first introduction port into condensed fuel vapor and fuel lean vapor, a condensed-fuel-vapor discharge port disposed on an inlet side of the gas separation membrane and discharging condensed fuel vapor, and a fuel-lean-vapor discharge port disposed on a permeation side of the gas separation membrane and discharging fuel lean vapor;

a first passage that provides fluid communication between the fuel tank and the first introduction port;

a fuel-vapor dissolution device that introduces condensed fuel vapor discharged from the condensed-fuel-vapor discharge port into the fuel tank and dissolves this condensed fuel vapor in fuel;

a canister including a second introduction port introducing fuel lean vapor discharged from the fuel-lean-vapor discharge port, an adsorption part adsorbing fuel vapor in fuel lean vapor introduced from the second introduction port, a second discharge port including a second control valve and discharging vapor having fuel vapor removed, and a desorption device desorbing fuel vapor from the adsorption part;

a fuel-lean-vapor discharge passage that provides fluid communication between the fuel-lean-vapor discharge port and the second introduction port, the fuel-lean-vapor discharge passage including a pump reducing the pressure on the permeation side of the gas separation membrane; and an electronic control unit (ECU) comprising a first control device that, when the internal pressure of the fuel tank detected by the pressure gauge is at least a predetermined value, drives the pump to actuate the system and opens the second control valve and a second control device that desorbs fuel vapor adsorbed to the canister through the desorption device.

2. The system according to claim 1, further comprising a second passage branching off from the first passage and a passage switching device disposed at a branching point of the first and second passages, the second passage communicating with the fuel-lean-vapor discharge passage between the pump and the fuel-lean-vapor discharge port, the second passage including a check valve, wherein the desorption device comprises an adsorption-amount detection device that detects an amount of fuel vapor adsorbed to the adsorption part and a third discharge port, including a third control valve, discharging fuel vapor desorbed from the adsorption part and introducing into the gas separation membrane module through the first introduction port, and wherein, when an adsorption amount detected by the adsorption-amount detection device is at least a predetermined value, the second control device performs initiates switching from the first passage to the second passage by the passage switching device, closes the second control valve and opens the third control valve to thereby desorb fuel vapor adsorbed to the adsorption part by fuel vapor introduced from the second passage, the desorbed fuel vapor being introduced into and condensed in the gas separation membrane module through the third discharge port and the first introduction port, the condensed fuel vapor being dissolved in fuel stored in the fuel tank by the fuel-vapor dissolution device.

3. The system according to in claim 2, wherein the gas separation membrane module comprises two gas separation membranes disposed in series and a fourth passage including a fourth control valve and communicating with a permeation side of the two gas separation membranes, wherein the ECU comprises a third control device that opens the fourth control valve when the passage switching device performs switching from the first passage to the second passage, and closes the fourth control valve when the passage switching device performs switching from the second passage to the first passage, thereby changing an area of the gas separation membrane.

* * * * *